US007612029B2

(12) United States Patent
Foland et al.

(10) Patent No.: US 7,612,029 B2
(45) Date of Patent: Nov. 3, 2009

(54) CONTROLLED RELEASE USING GELS IN A MELAMINE FOAM

(75) Inventors: Lafayette D. Foland, Dublin, CA (US); Mimi Y. Lee, Hayward, CA (US); David Lestage, Livermore, CA (US); Sara Morales, Pittsburg, CA (US)

(73) Assignee: The Clorox Company, Oakland, CA (US)

( * ) Notice: Subject to any disclaimer, the term of this patent is extended or adjusted under 35 U.S.C. 154(b) by 684 days.

(21) Appl. No.: 11/279,284

(22) Filed: Apr. 11, 2006

(65) Prior Publication Data

US 2007/0238634 A1 Oct. 11, 2007

(51) Int. Cl.
*C11D 3/37* (2006.01)
*C11D 3/22* (2006.01)
*C11D 3/48* (2006.01)

(52) U.S. Cl. ..... 510/295; 510/144; 510/145; 510/297; 510/382; 510/470; 510/499; 514/54; 514/55; 514/57; 424/443; 424/446; 424/447; 424/488

(58) Field of Classification Search ..... 510/144, 510/145, 295, 297, 382, 470, 499; 514/54, 514/55, 57; 424/443, 446, 447, 488
See application file for complete search history.

(56) References Cited

U.S. PATENT DOCUMENTS

| | | | | |
|---|---|---|---|---|
| 5,043,069 | A | 8/1991 | Brandon et al. | |
| 5,057,606 | A | 10/1991 | Garbe | |
| 5,094,770 | A | 3/1992 | Sheridan et al. | |
| 5,110,605 | A | 5/1992 | Acharya | |
| 5,421,898 | A | 6/1995 | Cavanagh | |
| 5,541,233 | A | 7/1996 | Roenigk | |
| 5,888,987 | A * | 3/1999 | Haynes et al. | 514/54 |
| 6,036,978 | A | 3/2000 | Gombotz et al. | |
| 6,254,932 | B1 | 7/2001 | Smith et al. | |
| 6,503,615 | B1 | 1/2003 | Horii et al. | |
| 6,608,118 | B2 | 8/2003 | Kosaka et al. | |
| 6,734,157 | B2 | 5/2004 | Radwanski et al. | |
| 6,911,437 | B2 | 6/2005 | Edwards et al. | |
| 6,916,480 | B2 | 7/2005 | Anderson et al. | |
| 2003/0064133 | A1 | 4/2003 | Blatt et al. | |
| 2004/0062855 | A1 | 4/2004 | Augello et al. | |
| 2004/0097609 | A1 * | 5/2004 | Hahnle et al. | 521/187 |
| 2005/0153857 | A1 | 7/2005 | Sherry et al. | |
| 2005/0277568 | A1 | 12/2005 | Keenan et al. | |
| 2006/0005338 | A1 | 1/2006 | Ashe et al. | |
| 2007/0154558 | A1 * | 7/2007 | Gaserod et al. | 424/488 |
| 2008/0139433 | A1 * | 6/2008 | Mock et al. | 510/158 |

FOREIGN PATENT DOCUMENTS

| | | |
|---|---|---|
| WO | WO2005/115215 | 12/2005 |

* cited by examiner

*Primary Examiner*—Charles I Boyer
(74) *Attorney, Agent, or Firm*—David Peterson; Thomas Feix

(57) ABSTRACT

A substrate comprising a nonwoven layer containing an ionically crosslinked polymer can be used to control the release of active ingredients. The substrate can be a melamine foam and contain a surfactant and an alginate polymer crosslinked with calcium.

14 Claims, No Drawings

CONTROLLED RELEASE USING GELS IN A MELAMINE FOAM

BACKGROUND OF THE INVENTION

1. Field of the Invention

The present invention relates generally to treatment formulations for incorporation into nonwoven substrates, including melamine foam. The invention also relates to cleaning substrates, cleaning heads, cleaning pads, cleaning sponges and related systems for cleaning hard surfaces, wherein the cleaning substrates and related systems are impregnated with cleaning compositions.

2. Description of the Related Art

U.S. Pat. No. 6,254,932 to Smith et al. discloses polysaccharide gums as dispersing agents for liquid fabric treatment compositions in fabric sheets. U.S. Pat. No. 6,911,437 to Edwards et al. discloses protease inhibitors in hydrogels or polysaccharide matrices in gauze for wound dressing. U.S. Pat. No. 6,036,978 and U.S. Pat. No. 5,110,605 disclose the controlled release of pharmaceuticals from alginate systems.

U.S. Pat. No. 6,503,615 to Horii et al. discloses melamine foam cleaners containing surfactants. U.S. Pat. App. 2006/0005338 to Ashe et al. discloses a cleaning implement having a layer of melamine foam and a layer of a second foam.

U.S. Pat. No. 6,734,157 to Radwanski et al. and U.S. Pat. No. 6,916,480 to Anderson et al. disclose the controlled-release of antimicrobials that are adhered to the fibers of wipers. U.S. Pat. No. 5,421,898 to Cavanagh describes the controlled-release of quaternary ammonium disinfectants using water-soluble polymers. U.S. Pat. No. 5,541,233 to Roenigk discloses a sponge containing a chitosan metal complex. U.S. patent application 2005/0153857 to Sherry et al. discloses wipes comprising hydrophilic polymers to render the cleaned surface hydrophilic.

It is therefore an object of the present invention to provide a nonwoven substrate impregnated with a controlled release gel composition that overcomes the disadvantages and shortcomings associated with prior art impregnated substrates and related systems.

SUMMARY OF THE INVENTION

In accordance with the above objects and those that will be mentioned and will become apparent below, one aspect of the present invention comprises a substrate comprising:

a. a melamine foam; and
b. a composition comprising:
   i. an active material selected from the group consisting of a surfactant, a fragrance, a dye, and combinations thereof, and
   ii. an ionically crosslinked polymer;
c. wherein the active material is substantially removed from the substrate upon rinsing with water.

In accordance with the above objects and those that will be mentioned and will become apparent below, another aspect of the present invention comprises a substrate comprising:

a. a layer selected from the group consisting of a nonwoven substrate, a woven substrate, and combinations thereof; and
c. a composition comprising:
   i. an active material selected from the group consisting of a surfactant, a fragrance, a dye, and combinations thereof, and
   ii. an ionically crosslinked polymer;
   iii. wherein the active material is substantionally removed from the substrate upon rinsing with water.

In accordance with the above objects and those that will be mentioned and will become apparent below, another aspect of the present invention comprises a method of making a substrate comprising the steps of:

a. providing a substrate layer;
b. contacting the substrate layer with a first composition comprising an ionically charged polymer; and
c. contacting the substrate layer with a second composition comprising a polyionic species of the opposite charge to that of the ionically charged polymer.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The cleaning substrate can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

As used herein, the term "substrate" is intended to include any material that is used to clean an article or a surface. A wide variety of materials can be used as the substrate. The substrate should have sufficient wet strength, abrasivity, loft and porosity. Examples of suitable substrates include, nonwoven substrates, wovens substrates, hydroentangled substrates, foams and sponges. The substrate can be attached to a cleaning implement, such as a floor mop, handle, or a hand held cleaning tool, such as a toilet cleaning device.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries. As used herein the term "thermoplastic" or "thermoplastic polymer" refers to polymers that will soften and flow or melt when heat and/or pressure are applied, the changes being reversible.

As used herein, "film" refers to a polymer film including flat nonporous films, and porous films such as microporous, nanoporous, closed or open celled, breathable films, or apertured films.

As used herein, "wiping" refers to any shearing action that the substrate undergoes while in contact with a target surface. This includes hand or body motion, substrate-implement motion over a surface, or any perturbation of the substrate via energy sources such as ultrasound, mechanical vibration, electromagnetism, and so forth.

As used herein, the terms "nonwoven" or "nonwoven web" means a web having a structure of individual fibers or threads which are interlaid, but not in an identifiable manner as in a knitted web. Nonwoven webs have been formed from many processes, such as, for example, meltblowing processes, spunbonding processes, and bonded carded web processes. The basis weight of nonwoven webs is usually expressed in ounces of material per square yard (osy) or grams per square meter (gsm) and the fiber diameters useful are usually expressed in microns, or in the case of staple fibers, denier. It is noted that to convert from osy to gsm, multiply osy by 33.91.

The term "sponge", as used herein, is meant to mean an elastic, porous material, including, but not limited to, compressed sponges, cellulosic sponges, reconstituted cellulosic sponges, cellulosic materials, foams from high internal phase emulsions, such as those disclosed in U. S. Pat. No. 6,525,106, polyethylene, polypropylene, polyvinyl alcohol, polyurethane, polyether, and polyester sponges, foams and nonwoven materials, and mixtures thereof.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

Melamine Foam

Melamine foam is an example of a substrate that has a fine irregular wiping surface wherein upon wiping, particles are peeled from the wiping surface by friction. Suitable melamine foam is described in U.S. Pat. No. 6,608,118 to Kosaka et al. and U.S. Pat. No. 6,503,615 to Horii et al. Melamine foam refers to a melamine-formaldehyde resin foam. A suitable melamine-formaldehyde resin foam raw material is commercially available under the trade name Basotect® from BASF. The melamine foam can be prepared by blending major starting materials of melamine and formaldehyde, or a precursor thereof, with a blowing agent, a catalyst and an emulsifier, injecting the resultant mixture into a mold, and making the reaction mixture generate heat through a proper means such as heating or irradiation with electromagnetic wave to cause foaming and curing. The molar ratio of melamine to formaldehyde (i.e., melamine:formaldehyde) for producing the precursor is preferably 1:1.5 to 1:4, particularly preferably 1:2 to 1:3.5 in melamine:formaldehyde. In addition, number average molecular weight of the precursor is preferably 200 to 1,000, particularly preferably 200 to 400. Additionally, formalin, which is an aqueous solution of formaldehyde, is usually used as formaldehyde. As monomers for producing the precursor, the following various monomers may be used in an amount of 50 parts by weight (hereinafter abbreviated as "parts") or less, particularly 20 parts by weight or less, per 100 parts by weight of the sum of melamine and formaldehyde in addition to melamine and formaldehyde. As other monomers corresponding to melamine, there may be used C1-5 alkyl-substituted melamines such as methylolmelamine, methylmethylolmelamine and methylbutylolmelamine, urea, urethane, carbonic acid amides, dicyandiamide, guanidine, sulfurylamides, sulphonic acid amides, aliphatic amines, phenols and the derivatives thereof As aldehydes, there may be used acetaldehyde, trimethylol acetaldehyde, acrolein, benzaldehyde, furfurol, glyoxal, phthalaldehyde, terephthalaldehyde, etc.

Other Foam

Other suitable foams for use herein include polyurethane foams; polypropylene foams; polyethylene foams; cellulose foam sponges; naturally occurring sponges; open-cell polyester foams; and crosslinked polyethylene foams; and combinations thereof Nonwoven Substrate In one embodiment, the substrate of the present invention comprises a nonwoven substrate or web. The substrate is composed of nonwoven fibers or paper. The term nonwoven is to be defined according to the commonly known definition provided by the "Nonwoven Fabrics Handbook" published by the Association of the Nonwoven Fabric Industry. A paper substrate is defined by EDANA (note 1 of ISO 9092-EN 29092) as a substrate comprising more than 50% by mass of its fibrous content is made up of fibers (excluding chemically digested vegetable fibers) with a length to diameter ratio of greater than 300, and more preferably also has density of less than 0.040 g/cm$^3$. The definitions of both nonwoven and paper substrates do not include woven fabric or cloth or sponge. The substrate can be partially or fully permeable to water. The substrate can be flexible and the substrate can be resilient, meaning that once applied external pressure has been removed the substrate regains its original shape.

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber- laden air or water is passed. The air-laying process is described in U.S. Pat. App. 2003/0036741 to Abba et al. and U.S. Pat. App. 2003/0118825 to Melius et al. The resulting layer, regardless of its method of production or composition, is then subjected to at least one of several types of bonding operations to anchor the individual fibers together to form a self-sustaining substrate. In the present invention the nonwoven substrate can be prepared by a variety of processes including, but not limited to, air-entanglement, hydroentanglement, thermal bonding, and combinations of these processes.

Unbonded conjugate fiber webs, including conjugate staple fiber webs and conjugate spunbond webs, can be bonded using a conventional bonding process that does not significantly compact the webs. Such processes include through-air bonding, powder adhesive bonding, liquid adhesive bonding, ultrasonic bonding, needling and hydroentangling. These bonding processes are conventional and well known in the art. Among these bonding processes, through-air bonding processes are particularly suitable for the present invention since the bonding processes bond the conjugate fiber webs without applying any substantial compacting pressure and, thus, produce lofty, uncompacted substrate. Similarly, the nonwoven webs of monocomponent fibers, including staple fiber webs and spunbond fiber webs, can be bonded with the above-disclosed bonding processes other than through-air bonding processes. Through-air bonding processes are not particularly suitable for monocomponent fiber webs unless the processes are used in conjunction with powder adhesive bonding or fluid adhesive bonding processes since through-air bonding processes, which need to melt the web fibers to effect bonds, produce flattened webs having a non-uniform loft.

Additionally, the first layer and the second layer, as well as additional layers, when present, can be bonded to one another in order to maintain the integrity of the article. The layers can be heat spot bonded together or using heat generated by ultrasonic sound waves. The bonding may be arranged such that geometric shapes and patterns, e.g. diamonds, circles, squares, etc. are created on the exterior surfaces of the layers and the resulting article.

Chitosan

Chitosan is a natural biopolymer comprising linked glucosamine-units. As described herein, the term chitosan includes not only the natural polysaccharide obtained deacetylation of chitin (from marine source) or by direct isolation from fungi, but also includes synthetically produced β-1,4-poly-D-glucosamines and derivatives thereof that are isomers or structurally similar to natural chitosan. The chitosan polymers of the invention can have substantially protonated glucosamine monomeric units, improving polymer water solubility. The counterions associated with protonated glucosamine units can be any known in the art, for example lactate, acetate, gluconate and the like. Chitosan may be available from Vanson HaloSource, Inc. Chitosan derivatives are also suitable, for example, N-hydroxybutyl chitosans described in U.S. Pat. No. 4,931,271 to Lang et al. and chitosan pyrithione derivatives described in U.S. Pat. No. 4,957,908 to Nelson. Other chitosan derivatives include microcrystalline chitosan and quatemized chitosan. Chitosan derivatives are commercially available as, for example, chitosan neutralized with pyrrolidone carboxylic acid available as Kytamer PCA from Amerchol Corporation; carboxymethyl sodium salt of chitosan available as Chitisol from Muto Corporation; chitosan neutralized with glutamic acid available as Seacure+210 from Protan Corporation; N,O-carboxymethyl chitosan available from Nova Chem Ltd., Canada; and un-neutralized chitosan available from Tokyo Kasei Inc. Suitable chitosan derivatives for this invention are the dermatologically-compatible salts of chitosan such as those with pyrrolidone carboxylic acid, glutamic acid, acetate, etc., and also N,O-carboxymethyl chitosan.

When present in solution, the chitosan level in the compositions of the present invention is from about 0.001% to about 5.0%, or from about 0.01% to about 0.75%, or from about 0.01% to about 0.50%, or from about 0.02% to about 0.40%. Chitosan polymers of the invention have an average molecular weight of between about 5,000 and about 500,000, or between about 5,000 and about 100,000, or between about 5,000 and about 50,000, or between about 5,000 and about 30,000. The use of lower molecular weight chitosans as described above can improve composition water solubility. Lower molecular chitosan (i.e., Mw below 100,000 or below 50,000) provides flexibility to increase chitosan concentration (0.10% and beyond) in the compositions of the present invention. Higher molecular weight (Mw 50,000 to 100, 000) provides flexibility for lower chitosan concentrations (below about 0. 10%) in the compositions of the present invention.

Additional Cationic Polymers

Additional polysaccharides suitable for use in the composition according to the invention include, but are not limited to guar, hydroxypropyl guar and starch. A "cationic polysaccharide" is a polysaccharide having positively charged sites. The cationic charge on the cationic polysaccharide may be derived from ammonium groups, bound transition metals, and other positively charged functional groups. Chitosan is believed to be the only naturally occurring cationic polysaccharide. Guar, hydroxypropyl guar, and starch are not naturally charged. However, guar, hydroxypropyl guar, and starch may be "cationized" by chemical quaternization (alkoxylation with a quaternary epoxide). The process can be performed on other types of polysaccharides besides guar, hydroxypropyl guar, and starch. Cationic starch may be available from suppliers, such as AE Staley. Cationic guar may be available from suppliers, such as Hercules or Multi-Chem Corporation.

Cationic polymers can also be formed as homopolymers or copolymers of monomers having a cationic charge. Examples of permanently cationic monomers include, but are not limited to, quaternary ammonium salts of substituted acrylamide, methacrylamide, acrylate and methacrylate, such as trimethylammoniumethyl methacrylate, trimethylammoniumpropyl methacrylamide, trimethylammoniumethyl methacrylate, trimethylammoniumpropyl acrylamide, 2- vinyl N-alkyl quaternary pyridinium, 4-vinyl N-alkyl quaternary pyridinium, 4-vinylbenzyltrialkylammonium, 2- vinyl piperidinium, 4-vinyl piperidinium, 3-alkyl 1-vinyl imidazolium, diallyldimethylammonium, and the ionene class of internal cationic monomers as described by D. R. Berger in *Cationic Surfactants, Organic Chemistry*, edited by J. M. Richmond, Marcel Dekker, New York, 1990, ISBN 0-8247-8381-6, which is incorporated herein by reference. This class includes co-polyethyleneimine, co-poly ethoxylatedethylene imine and co-poly quaternizedethoxylatedethylene imine, co-poly [(dimethylimino)trimethylene(dimethylimino)hexamethylene disalt], co-poly [(diethylimino)trimethylene (dimethylimino)trimethylene disalt], co-poly [(dimethylimino) 2-hydroxypropyl salt], co-polyquarternium-2, co-polyquarternium-17, and co-polyquarternium-18, as described in the *International Cosmetic Ingredient Dictio-*

*nary,* 5th Edition, edited by J. A. Wenninger and G. N. McEwen, which is incorporated herein by reference. Other cationic monomers include those containing cationic sulfonium salts such as co-poly-1-[3-methyl-4-(vinyl-benzyloxy)phenyl]tetrahydrothiophenium chloride. Suitable monomers are mono- and di-quaternary derivatives of methacrylamide. The counterion of the cationic co-monomer can be selected from, for example, chloride, bromide, iodide, hydroxide, phosphate, sulfate, hydrosulfate, ethyl sulfate, methyl sulfate, formate, and acetate.

Examples of monomers that are cationic on protonation include, but are not limited to, acrylamide, N,N-dimethylacrylamide, N,N di-isopropylacryalmide, N-vinylimidazole, N-vinylpyrrolidone, ethyleneimine, dimethylaminohydroxypropyl diethylenetriamine, dimethylaminoethyl methacrylate, dimethylaminopropyl methacrylamide, dimethylaminoethyl acrylate, dimethylaminopropyl acrylamide, 2-vinyl pyridine, 4-vinyl pyridine, 2-vinyl piperidine, 4-vinylpiperidine, vinyl amine, diallylamine, methyldiallylamine, vinyl oxazolidone; vinyl methyoxazolidone, and vinyl caprolactam.

Monomers that are cationic on protonation typically contain a positive charge over a portion of the pH range of 2-11. Such suitable monomers are also presented in *Water-Soluble Synthetic Polymers: Properties and Behavior*, Volume II, by P. Molyneux, CRC Press, Boca Raton, 1983, ISBN 0-8493-6136. Additional monomers can be found in the *International Cosmetic Ingredient Dictionary,* 5th Edition, edited by J. A. Wenninger and G. N. McEwen, The Cosmetic, Toiletry, and Fragrance Association, Washington D.C., 1993, ISBN 1-882621-06-9. A third source of such monomers can be found in *Encyclopedia of polymers and Thickeners for Cosmetics*, by R. Y. Lochhead and W. R. Fron, Cosmetics & Toiletries, vol. 108, May 1993, pp 95-135. All three references are incorporated herein.

Suitable cationic polymers can also include anionic and nonionic monomers. Examples of acidic monomers that are capable of forming an anionic charge in the composition include, but are not limited to, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, and sulfoethyl acrylate. Suitable acid monomers also include styrenesulfonic acid, 2-methacryloyloxymethane-1-sulfonic acid, 3- methacryloyloxypropane-1-sulfonic acid, 3-(vinyloxy) propane-1-sulfonic acid, ethylenesulfonic acid, vinyl sulfuric acid, 4-vinylphenyl sulfuric acid, ethylene phosphonic acid and vinyl phosphoric acid. Suitable monomers include acrylic acid, methacrylic acid and maleic acid. The copolymers useful in this invention may contain the above acidic monomers and the alkali metal, alkaline earth metal, and ammonium salts thereof.

Examples of monomers having an uncharged hydrophilic group include but are not limited to vinyl alcohol, vinyl acetate, vinyl methyl ether, vinyl ethyl ether, ethylene oxide and propylene oxide. Especially preferred are hydrophilic esters of monomers, such as hydroxyalkyl acrylate esters, alcohol ethoxylate esters, alkylpolyglycoside esters, and polyethylene glycol esters of acrylic and methacrylic acid. Finally, examples of uncharged hydrophobic monomers include, but are not limited to, $C_1$-$C_4$ alkyl esters of acrylic acid and of methacrylic acid.

The copolymers are formed by copolymerizing the desired monomers. Conventional polymerization techniques can be employed. Illustrative techniques include, for example, solution, suspension, dispersion, or emulsion polymerization. A suitable method of preparation is by precipitation or inverse suspension polymerization of the copolymer from a polymerization media in which the monomers are dispersed in a suitable solvent. The monomers employed in preparing the copolymer are suitably water soluble and sufficiently soluble in the polymerization media to form a homogeneous solution. They readily undergo polymerization to form polymers which are water-dispersable or water-soluble. Suitable copolymers contain acrylamide, methacrylamide and substituted acrylamides and methacrylamides, acrylic and methacrylic acid and esters thereof. Suitable synthetic methods for these copolymers are described, for example, in Kirk-Othmer, *Encyclopedia of Chemical Technology*, Volume 1, Fourth Ed., John Wiley & Sons.

Anionic Polymers and Copolymers

Suitable natural anionic polymers include saccharinic gums such as alginates, xanthates, pectins, carrageenans, guar, carboxymethyl cellulose, and scleroglucans. Many commercially available forms of these have been cleared for food use.

Algin is a polysaccharide found in brown algae. Alginates are manufactured from brown sea-weed and are utilized in several applications where their polyelectrolytic nature forms the basis for e. g. gelation, thickening as well as water- and ion-binding. Alginic acid is a purified polysaccharide, linear polymer which is extracted from seaweed and is available in many forms, especially as a calcium, potassium, or sodium salt, or as propylene glycol alginate. Suitably, the sodium salt is employed in the present invention.

Chemically speaking, alginates constitute a group of linear, binary copolymers built up of salts of .beta.-D-mannuronic acid (M) and its C-5 epimer, .alpha.-L-guluronic acid (G). The M and G units are found in three types of sequences; G-rich sequences called G-blocks, M- rich sequences called M-blocks, and alternating sequences found in MG- blocks, symbolized MGMG. The fractional content of these monomer units as well as their sequencial distribution varies with the algal source. The ion binding and gel-forming properties depend on the monomer fractions, but in particular on the distribution of G-units along the chain. A high content of G-blocks leads to the technically important gel-forming properties.

Suitable synthetic anionic polymers can formed from anionic monomers by themselves or with nonionic or cationic monomers, such as those listed above. Anionic polymers include polyelectrolytes, such as poly(acrylic acid) (PAA) and copolymers or a polymer of 2-acrylamido-2-methylpropane sulphonic acid, such as poly(AMPS) and copolymers, or natural polymers i.e. alginate, or copolymers of an unsaturated acid (and related monomers) with acrylate esters, styrene, and other vinyl or unsaturated monomers. Acumer 3100 is a copolymer of acrylic acid and AMPS supplied by Rohm&Haas. Other potential anionic monomers include sulfonated styrene (SS), sulfonated alkyl acrylamides, such as 2-acrylamidomethyl propanesulfonic (AMPS), vinyl sulfonates, allylsulfonic acid, methallylsulfonic acid, vinyl phosphonic acid.

Acrysol LMW-45®, a polyacrylic acid having an average molecular weight of 4,500 in a 50% aqueous solution, is available from the Rohm and Haas Company. Acrysol LMW-45ND®, a granular polyacrylic acid having an average molecular weight of 4,500, available from the Rohm and Haas Company. Acrysol LMW-1ON®, an aqueous solution of average molecular weight of 1,000, is available from Rohm and Haas Company. Acrysol LMW-1 OON®, an aqueous solution of polyacrylic acid having an average molecular weight of 10,000, is available from Rohm and Haas Company. Alcosperse 149®, a polyacrylate having an average molecular weight of about 2,000, is available from Alco Chemical Company. Alcosperse 175®, a ring opened copolymer of acrylic acid and maleic anhydride having an average molecular weight of about 20,000, is available from Alco Chemical Company. Belsperse 161®, a 50% aqueous solution of a polyacrylate containing phosphono groups in the backbone which has a molecular weight of about 4,000, is available from Ciba-Geigy. Goodright 7058D®, a powdered salt of granular polyacrylic acid having an average molecular weight of about 6,000, is available from B. F. Goodrich. Suitable polycarboxylate polymers and copolymers are copolymers of acrylic acid and maleic anhydride or alkali metal salts thereof, such as the sodium and potassium salts. Suitable are copolymers of acrylic acid or methacrylic acid with vinyl ethers, such as, for example, vinyl methyl ether, vinyl esters, ethylene, propylene and styrene. Examples of commercially available products are Sokalan CP5® and PA30® from BASF, Alcosperse 175® or 177® from Alco and LMW 45N® and SPO2N® from Norsohaas.

In one non-limiting embodiment, suitable sulfonated/carboxylated polymers may comprise: (a) from about 0.01 mole % to less than 4 mole % of at least one sulfonate functionality; and (b) from about 99.99 mole % to about 96 mole % of a carboxylic acid functionality. In another non-limiting embodiment, suitable sulfonated/carboxylated polymers may comprise: (a) from about 0.01 mole % to about 95.99 mole % of at least one nonionic functionality; (b) from about 0.01 mole % to less than 4 mole % of at least one sulfonate functionality; and (c) from about 99.98 mole % to about 0.01 mole % of a carboxylic acid functionality. In another non-limiting embodiment, sulfonated/carboxylated polymers may comprise an aromatic monomer, such as styrene. In another non-limiting embodiment, the at least one carboxylic acid functionality can comprise one or more of the following: acrylic acid, maleic acid, itaconic acid, methacrylic acid, or ethoxylate esters of acrylic acids. In another non-limiting embodiment, the sulfonate functionality can comprise one or more of the following: sodium (meth)allyl sulfonate, vinyl sulfonate, sodium phenyl (meth)allyl ether sulfonate, or 2-acrylamido-methyl propane sulfonic acid. In another non-limiting embodiment, the optional one or more nonionic functionality can comprise one or more of the following: methyl(meth)acrylate, ethyl(meth)acrylate, t-butyl (meth)acrylate, methyl(meth)acrylamide, ethyl(meth)acrylamide, t-butyl(meth)acrylamide, styrene, or a-methyl styrene. In another non-limiting embodiment, a surface-treating composition may comprise sulfonated/carboxylated polymers comprising styrene, having a molecular weight of less than or equal to about 100,000 Da. Suitable sulfonated/carboxylated polymers are described in U.S. Pat. App. 2005/0202995 to Waits et al. and may have a weight average molecular weight of less than or equal to about 100,000 Da, or less than or equal to about 75,000 Da, or less than or equal to about 50,000 Da, or from about 10,000 Da to about 50,000, or from about 15,000 Da to about 50,000 Da; or from about 20,000 Da to about 50,000 Da, or alternatively from about 25,000 Da to about 50,000 Da.

Polyvalent Metal Ion

Ionically charged polymers can be ionically crosslinked by polyvalent ions of the opposite charge. Suitable polyvalent metal ions include, but are not limited to, divalent and trivalent metal ions and their salts. Suitable metal ions include calcium, magnesium, copper, aluminum and zinc. Suitable metal ion salts include, but are not limited to, acetates, bicarbonates, bisulfides, borates, carbonates, citrates, formates, glycinates, hydroxides, imides, nitrates, nitrites, oxides, phosphates, and sulphates. In one embodiment, 1 to 20% of calcium chloride was incorporated into the composition.

Polyvalent Anionic Species

In one aspect of this embodiment, the polyvalent anionic species is an organic species. Suitable examples include, but are not limited to, sodium and potassium salts of citrate, tartrate, lactate, ethylenediaminetetraacetic acid, glutamate, ascorbate, oxalate, salicylate, and other polycarboxylates.

In one aspect of this embodiment, the polyvalent anionic species is an inorganic species. Suitable examples include, but are not limited to salts of boric acid, sulfuric acid, sulfurous acid, carbonic acid, phosphoric acid, and chromic acid.

Cleaning or Treatment Composition

The cleaning composition may contain one or more surfactants selected from anionic, nonionic, cationic, ampholytic, amphoteric and zwitterionic surfactants and mixtures thereof. A typical listing of anionic, nonionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, ampholytic, amphotenic and zwitterionic surfactants are generally used in combination with one or more anionic and/or nonionic surfactants. The surfactants may be present at a level of from about 0% to 90%, or from about 0.001% to 50%, or from about 0.01% to 30% by weight.

The cleaning composition may contain one or more solvents. Suitable organic solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. The solvents are suitably present at a level of from 0.001% to 10%, or from 0.01% to 10%, or from 1% to 4% by weight.

The cleaning compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA). The mildewstat or bacteriostat includes, but is not limited to, mildewstats (including non-isothiazolone compounds) include Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G.

The compositions can also comprise an effective amount of a skin care agent such as a kerotolytic, for providing the function of encouraging healing of the skin. An especially preferred kerotolytic is Allantoin ((2,5-Dioxo-4-Imidazolidinyl)Urea), a heterocyclic organic compound having an empirical formula $C_4H_6N_4O_3$. Allantoin is commercially available from Tri-K Industries of Emerson, N.J. A premoistened wipe according to the present invention may optionally include an effective amount of allantoin for encouraging the healing of skin, such as skin which is over hydrated. Another suitable skin care agent is Sensiva SC50®, which is available from Phonex Chemicals, N.J., USA. Sensiva SC50®, contains 3[(2-ethylhexyl)oxy]1,2-propanediol.

The compositions of the present invention may also optionally include other agents such as: skin soothing aids such as panthenol, bisabolol, ichthammol, stearyl glycyrrhetinate, ammonium glycyrrhetinate, Vitamin E (tocopherol or tocopherol acetate), Vitamin A (Retinyl or Retinyl Palmitate); plant extracts, such as, green tea extract, kola extract, oat extract, teat tree extract and aloe; and skin moisteners; powders and the like.

Antimicrobial Agent

The cleaning compositions optionally contain one or more antimicrobial agents. An effective amount on antimicrobial active may be needed on the substrate depending on the size of the surface to be cleaned and the level of antimicrobial effectiveness desired. Antimicrobial agents include quaternary ammonium compounds and phenolics. Non-limiting examples of these quaternary compounds include benzalkonium chlorides and/or substituted benzalkonium chlorides, di($C_6$-$C_{14}$)alkyl di short chain ($C_{1-4}$ alkyl and/or hydroxyalkl) quatemaryammonium salts, N-(3-chloroallyl)hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chloro-benzhydryl biguanide, halogenated hexidine such as, but not limited to, chlorhexidine (1,1'-hexamethylene-bis-5-(4-chlorophenyl biguanide) and its salts are also in this class.

Additional antimicrobial agents include metallic materials, which bind to cellular proteins of microorganisms and are toxic to the microorganisms are suitable. The metallic material can be a metal, metal oxide, metal salt, metal complexes or salts, metal alloy or mixture thereof. Metallic materials, which are bactericidal or bacteriostatic and are either substantially water-insoluble or can be rendered water insoluble are suitable. By a metallic material that is bacteriostatic or bactericidal is meant a metallic material that is bacteriostatic to a microorganism, or that is bactericidal to a microorganism, or that is bactericidal to certain microorganisms and bacteriostatic to other microorganisms. Examples of such metals include, silver, zinc, cadmium, lead, mercury, antimony, gold, aluminum, copper, platinum and palladium, their salts, oxides, complexes, and alloys, and mixtures thereof. The appropriate metallic material is chosen based upon the use to which the invention is to be put. Suitable metallic materials are silver compounds, including silver citrate. In a suitable embodiment, a silver halide is used, for example, silver iodide. In another suitable embodiment silver nitrate is used and is converted into a water insoluble silver halide by subsequent chemical reaction with an alkali halide. Suitably, silver nitrate is converted to silver iodide by reacting it with sodium or potassium iodide. The concentration of metallic biocide is typically in the range from about 0.001 to about 20% by weight of the composition.

Additional antimicrobial agents include alpha-hydroxycarboxylic acids and related compounds. Suitable in the present invention are alpha-hydroxycarboxylic acids selected from alkyl alpha-hydroxyacids, aralkyl and aryl alpha-hydroxyacids, polyhydroxy alpha-hydroxyacids, polycarboxylic alpha-hydroxyacids, alpha-hydroxyacid related compounds, alpha-ketoacids and related compounds, and other related compounds including their lactone forms. Suitable alkyl alpha-hydroxyacids for use in the present invention include 2-hydroxyethanoic acid (glycolic acid), 2-hydroxypropanoic acid (lactic acid), 2-methyl 2-hydroxypropanoic acid (methyllactic acid), 2-hydroxybutanoic acid, 2-hydroxypentanoic acid, 2-hydroxyhexanoic acid, 2-hydroxyheptanoic acid, 2-hydroxyoctanoic acid, 2-hydroxynonanoic acid, 2-hydroxydecanoic acid, 2-hydroxyundecanoic acid, 2-hydroxydodecanoic acid (alpha-hydroxylauric acid), 2-hydroxytetradecanoic acid (alpha-hydroxymyristic acid), 2-hydroxyhexadecanoic acid (alpha-hydroxypalmitic acid), 2-hydroxyoctadecanoic acid (alpha-hydroxystearic acid) and 2-hydroxyeicosanoic acid (alpha-hydroxyarachidonic acid). Suitable aralkyl and aryl alpha-hydroxyacids for use in the present invention include 2-phenyl 2-hydroxyethanoic acid (mandelic acid), 2,2-diphenyl 2-hydroxyethanoic acid (benzilic acid), 3-phenyl 2-hydroxypropanoic acid (phenyllactic acid), 2-phenyl 2-methyl 2-hydroxyethanoic acid (atrolactic acid), 2-(4'-hydroxyphenyl) 2-hydroxyethanoic acid, 2-(4'-clorophenyl) 2-hydroxyethanoic acid, 2-(3'-hydroxy-4'-methoxyphenyl) 2-hydroxyethanoic acid, 2-(4'-hydroxy-3'-methoxyphenyl) 2-hydroxyethanoic acid, 3-(2'-hydroxyphenyl) 2-hydroxypropanoic acid, 3-(4'-hydroxyphenyl)2-hydroxypropanoic acid and 2-(3',4'-dihydroxyphenyl)2-hydroxyethanoic acid. Suitable polyhydroxy alpha-hydroxyacids for use in the present invention include 2,3-dihydroxypropanoic acid (glyceric acid), 2,3,4-trihydroxybutanoic acid (isomers; erythronic acid, threonic acid), 2,3,4,5-tetrahydroxypentanoic acid (isomers; ribonic acid, arabinoic acid, xylonic acid, lyxonic acid), 2,3,4,5,6-pentahydroxyhexanoic acid (isomers; aldonic acid, altronic acid, gluconic acid, mannoic acid, gulonic acid, idonic acid, galactonic acid, talonic acid) and 2,3,4,5,6,7-hexahydroxyheptanoic acid (isomers; glucoheptonic acid, galactoheptonic acid, etc.) . Suitable polycarboxylic alpha-hydroxyacids for use in the present invention include 2-hydroxypropane-1,3-dioic acid (tartronic acid), 2-hydroxybutane-1,4-dioic acid (malic acid), 2,3-dihydroxybutane-1,4-dioic acid (tartaric acid), 2-hydroxy-2-carboxypentane-1,5-dioic acid (citric acid) and 2,3,4,5-tetrahydroxyhexane-1,6-dioic acid (isomers; saccharic acid, mucic acid, etc.). Suitable alpha-hydroxyacid related compounds suitable for use in the present invention include ascorbic acid, quinic acid, isocitric acid, tropic acid, 3-chlorolactic acid, trethocanic acid, cerebronic acid, citramalic acid, agaricic acid and 2-hydroxynervonic acid and aleuritic acid. Suitable alpha-ketoacids and related compounds suitable for use in the present invention include 2-ketoethanoic acid (glyoxylic acid), methyl 2-ketoethanoate, 2-ketopropanoic acid (pyruvic acid), methyl 2-ketopropanoate (methyl pyruvate), ethyl 2-ketopropanoate (ethyl pyruvate), propyl 2-ketopropanoate (propyl pyruvate), 2-phenyl-2-ketoethanoic acid (benzoylformic acid), methyl 2-phenyl-2-ketoethanoate (methyl benzoylformate), ethyl 2-phenyl-2-ketoethanoate (ethyl benzoylformate), 3-phenyl-2-ketopropanoic acid (phenylpyruvic acid), methyl 3-phenyl-2-ketopropanoate (ethyl phenylpyruvate), 2-ketobutanoic acid, 2-ketopentanoic acid, 2-ketohexanoic acid, 2-ketoheptanoic acid, 2-ketooctanoic acid, 2-ketododecanoic acid and methyl 2-ketooctanoate. Also suitable are the dimeric and polymeric forms of alpha-hydroxyacids and the related compounds which may be incorporated into the compositions of the present invention including, but are not limited to, acyclic esters and cyclic esters such as glycolyl glycollate, ethyl lactate, lactyl lactate, glycolide, lactide, polyglycolic acid and polylactic acid. The alpha-hydroxycarboxylic acid is generally present at a level of between 0.5 to 25.0 wt % of the total composition.

Additional antimicrobial agents include hypohalite compounds and similar compounds that may be provided by a variety of sources, including compounds that lead to the formation of positive halide ions and/or hypohalite ions, as well as bleaches that are organic based sources of halides, such as chloroisocyanurates, haloamines, haloimines, haloimides and haloamides, or mixtures thereof. These compounds also produce hypohalite species in situa. Suitable hypohalite compounds for use herein include the alkali metal and alkaline earth metal hypochlorites, hypobromites, hypoiodites, chlorinated trisodium phosphate dodecahydrates, potassium and sodium dichloroisocyanurates, potassium and sodium trichloro-cyanurates, N-chloroimides, N-chloroamides, N-chlorosulfamide, N-chloroamines, chlorohydantoins, such as dichlorodimethyl hydantoin and chlorobromo dimethylhydantoin, or mixtures thereof. Other suitable antimicrobial agents include peroxides and their derivatives.

Essential Oils

Compositions according to the invention may comprise pine oil, terpene derivatives or other essential oils. Pine oil, terpene derivatives and essential oils are used primarily for cleaning efficacy. They may also provide some antimicrobial efficacy and deodorizing properties. Pine oil, terpene derivatives and essential oils may be present in the compositions in amounts of up to about 5% by weight, suitably in amounts of 0.01% to 0.5% by weight.

Pine oil is a complex blend of oils, alcohols, acids, esters, aldehydes and other organic compounds. These include terpenes that include a large number of related alcohols or ketones. Some important constituents include terpineol. One type of pine oil, synthetic pine oil, will generally contain a higher content of turpentine alcohols than the two other grades of pine oil, namely steam distilled and sulfate pine oils. Other important compounds include alpha- and beta-pinene (turpentine), abietic acid (rosin), and other isoprene derivatives. Particularly effective pine oils are commercially available from Mellennium Chemicals, under the Glidco tradename. These pine oils vary in the amount of terpene alcohols and alpha-terpineol.

Terpene derivatives appropriate for use in the inventive composition include terpene hydrocarbons having a functional group, such as terpene alcohols, terpene ethers, terpene esters, terpene aldehydes and terpene ketones. Examples of suitable terpene alcohols include verbenol, transpinocarveol, cis-2-pinanol, nopol, isobomeol, carbeol, piperitol, thymol, alpha-terpineol, terpinen-4-ol, menthol, 1,8-terpin, dihydroterpineol, nerol, geraniol, linalool, citronellol, hydroxycitronellol, 3,7-dimethyl octanol, dihydro-myrcenol, tetrahydro-alloocimenol, perillalcohol, and falcarindiol. Examples of suitable terpene ether and terpene ester solvents include 1,8-cineole, 1,4-cineole, isobomyl methylether, rose pyran, menthofuran, trans-anethole, methyl chavicol, allocimene diepoxide, limonene mono-epoxide, isobornyl acetate, nonyl acetate, terpinyl acetate, linalyl acetate, geranyl acetate, citronellyl acetate, dihydro-terpinyl acetate and meryl acetate. Further, examples of suitable terpene aldehyde and terpene ketone solvents include myrtenal, campholenic aldehyde, perillaldehyde, citronellal, citral, hydroxy citronellal, camphor, verbenone, carvenone, dihydro-carvone, carvone, piperitone, menthone, geranyl acetone, pseudo- ionone, ionine, iso-pseudo-methyl ionone, n-pseudo-methyl ionone, iso-methyl ionone and n-methyl ionone.

Essential oils include, but are not limited to, those obtained from thyme, lemongrass, citrus, lemons, oranges, anise, clove, aniseed, pine, cinnamon, geranium, roses, mint, lavender, citronella, eucalyptus, peppermint, camphor, sandalwood, rosmarin, vervain, fleagrass, lemongrass, ratanhiae, cedar and mixtures thereof. Suitable essential oils to be used herein are thyme oil, clove oil, cinnamon oil, geranium oil, eucalyptus oil, peppermint oil, mint oil or mixtures thereof.

Actives of essential oils to be used herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, ferulic acid, cinnamic acid, methyl salycilic acid, methyl salycilate, terpineol and mixtures thereof. Suitable actives of essential oils to be used herein are thymol, eugenol, verbenone, eucalyptol, terpineol, cinnamic acid, methyl salycilic acid, and/or geraniol.

Other essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobomyl acetate, Isolongifolene, Juniper berry oil, L-methhyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen. Each of these botanical oils is commercially available.

Suitable oils include peppermint oil, lavender oil, bergamot oil (Italian), rosemary oil (Tunisian), and sweet orange oil. These may be commercially obtained from a variety of suppliers including: Givadan Roure Corp. (Clifton, N.J.); Berje Inc. (Bloomfield, N.J.); BBA Aroma Chemical Div. of Union Camp Corp. (Wayne, N.J.); Firmenich Inc. (Plainsboro N.J.); Quest International Fragrances Inc. (Mt. Olive Township, N.J.); Robertet Fragrances Inc. (Oakland, N.J.). Suitable lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit.

Nanoparticles

Nanoparticles, defined as particles with diameters of about 400 nm or less, are technologically significant, since they are utilized to fabricate structures, coatings, and devices that have novel and useful properties due to the very small dimensions of their particulate constituents. "Non-photoactive" nanoparticles do not use UV or visible light to produce the desired effects. Nanoparticles can have many different particle shapes. Shapes of nanoparticles can include, but are not limited to spherical, parallelpiped-shaped, tube shaped, and disc or plate shaped. Nanoparticles can be present from 0.01 to 1%.

Inorganic nanoparticles generally exist as oxides, silicates, carbonates and hydroxides. These nanoparticles are generally hydrophilic. Some layered clay minerals and inorganic metal oxides can be examples of nanoparticles. The layered clay minerals suitable for use in the coating composition include those in the geological classes of the smectites, the kaolins, the illites, the chlorites, the attapulgites and the mixed layer clays. Smectites include montmorillonite, bentonite, pyrophyllite, hectorite, saponite, sauconite, nontronite, talc, beidellite, volchonskoite and vermiculite. Kaolins include kaolinite, dickite, nacrite, antigorite, anauxite, halloysite, indellite and chrysotile. Illites include bravaisite, muscovite, paragonite, phlogopite and biotite. Chlorites include corrensite, penninite, donbassite, sudoite, pennine and clinochlore. Attapulgites include sepiolite and polygorskyte. Mixed layer clays include allevardite and vermiculitebiotite. Variants and isomorphic substitutions of these layered clay minerals offer unique applications.

Builder/Buffer

The cleaning composition may include a builder or buffer, which increase the effectiveness of the surfactant. The builder or buffer can also function as a softener and/or a sequestering agent in the cleaning composition. A variety of builders or buffers can be used and they include, but are not limited to, phosphate-silicate compounds, zeolites, alkali metal, ammonium and substituted ammonium poly-acetates, trialkali salts of nitrilotriacetic acid, carboxylates, polycarboxylates, carbonates, bicarbonates, polyphosphates, aminopolycarboxylates, polyhydroxy-sulfonates, and starch derivatives.

Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanol-amine. Other preferred nitrogen-containing buffering agents are tri (hydroxy-methyl) amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine(bicine) and N-tris(hydroxymethyl)methyl glycine(tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other preferred pH adjusting agents include sodium or potassium hydroxide.

When employed, the builder, buffer, or pH adjusting agent comprises at least about 0.001% and typically about 0.01-5% of the cleaning composition. Preferably, the builder or buffer content is about 0.01-2%.

Water

Since the composition is an aqueous composition, water can be, along with the solvent, a predominant ingredient. The water can be present at a level of less than 99.9%, or less than about 99%, or less than about 98%. Deionized water is suitable. Where the cleaning composition is concentrated, the water may be present in the composition at a concentration of less than about 85 wt. %.

EXAMPLES

Application of Alginate Compositions to Nonwoven

In one embodiment, one or more of the compositions of the invention can be added to the substrate by any means known in the art such as slot coating, spiral or bead application, spraying, roll transfer, extruding, or printing. Printing methods include gravure printing, reverse gravure printing, screen printing, flexographic printing, and the like. Another suitable process is wet foaming, which creates foams by adding air to a room temperature liquid surfactant solution. During the slot coating process a metered amount of the alginate solution, or other polymer, is added to a woven, nonwoven, or knitted material during the unwinding process. In a second step, the calcium chloride solution may be added to the alginate solution embedded into the woven, non-woven, or knitted material by the same or other process. Conversely, the alginate and calcium solutions may be added simultaneously to the woven, nonwoven or knitted material. In one embodiment, one or more of the compositions of the invention can be added to the substrate with an engraved roll, by spraying, dipping, or extrusion as described in U.S. Pat. No. 5,094,770 to Sheridan et al. and incorporated by reference. The calcium ionically crosslinks the alginate polymer.

In one embodiment, actives, including surfactants such as alkylpolyglycoside, antimicrobials such as ortho-benzylparachlorophenol, and colorants such as Liquitint Blue HP® can be incorporated into the composition with sodium alginate. In another embodiment, actives can be incorporated into the Ca containing solution. In another embodiment the composition is applied in three steps, as an actives composition, as an alginate composition, and as a calcium composition.

Foam Generation

Wipes were tested for foam generation by placing the alginate embedded wipe in a 1 L glass jar with 500 ml of water. The jar was put on a rotator for 1 minute and the height of foam generated was measured in cm. Rinse water was replaced by another 500 ml of fresh water and the process was repeated for up to 30 rinses.

The wipe substrate was loaded with a solution of 2.25% sodium alginate from Gumtech and 30% nonionic surfactant, APG325® from Cognis, followed by 5% calcium chloride solution. The wipe was then tested for foam generation and more foam was generated after 5 rinse cycles compared to the wipe sample treated with 2.25% sodium alginate, 30% APG325® and no calcium chloride. The wipe substrate was loaded with 2.25% sodium alginate and various levels of the anionic surfactant, Dowfax 2A1® from Dow Chemical, followed by 2.25% calcium chloride solution. At a level of 30% Dowfax 2A1®, the foam generated after 2 rinses was greater than that generated when 20% Dowfax 2A1® was used. The wipe was loaded with a solution of 2.25% sodium alginate and 30% anionic surfactant, sodium lauryl sulfate, followed by calcium chloride solution. At a level of 1% or 5% calcium chloride, substantial foam was generated after 30 rinse cycles compared to the same process with 0.5% calcium chloride solution. In these rinse tests, sodium lauryl sulfate was superior at longer rinse cycles to APG325® and Dowfax 2A1®. By combining APG325® and sodium lauryl sulfate in the alginate, both high initial foam and significant foam after several rinse cycles was obtained.

The amount of dye lost from the alginate embedded wipe could also be measured over multiple rinse cycles. At alginate concentrations of 1.5%, dye was lost faster from the substrate than at a higher 2.25% concentration of alginate.

Various levels of additive solutions were applied to 100 gsm spunlaced wipe of 70% rayon and 30% polyester at a level of 5-500% followed by 0-6.2% calcium chloride solution and are shown in Table 1. The compositions can also include up to 10% essential oils.

TABLE 1

| | Range (wt. %) |
|---|---|
| Alkylaryl disulfonate[a] | 10-40 |
| Sodium lauryl sulfate[b] | 15-30 |
| Sodium lauryl ether sulfate[c] | 15-30 |
| Alkylpolyglucoside[d] | 10-30 |
| Sodium Alginate | 0-3.29 |
| Liquitint Blue HP ® dye | 0-0.3 |
| Lavendar Oil | 0-0.5 |

[a]Dowfax 2A1 ® from Dow Chemical.
[b]Stepanol WA-EXTRA ® from Stepan Company.
[c]Calfoam ES-302 ® from Pilot Chemical Company.
[d]APG 325N ® from Cognis.

Application of Alginate Composition to Melamine Foam

The alginate compositions can be applied to melamine foam by pouring the solution onto substrate and spread it uniformly to form a thin, continuous coating layer, by an injection process using a syringe containing solution to insert into substrate, or by a dipping process. Examples of formulas suitable for incorporation into melamine foam by the above methods are shown in Tables 2 and 3 below.

TABLE 2

| | | | | | |
|---|---|---|---|---|---|
| First Solution | | | | | |
| Sodium Alginate | 2.50 | 2.00 | 1.00 | 2.00 | 1.00 |
| APG 325N | 10.0 | 10.0 | 5.0 | 5.0 | 15.0 |
| Dye | 0.01 | 0.01 | 0.01 | 0.01 | 0.01 |
| Fragrance | 0.1 | 0.1 | 0.1 | 0.1 | 0.1 |
| Second Solution | | | | | |
| Calcium chloride | 1.00 | 10.00 | 5.00 | 2.50 | |

TABLE 3

| | | | | | | |
|---|---|---|---|---|---|---|
| First Solution | | | | | | |
| Sodium Alginate | 2.50 | 2.00 | 1.00 | 2.00 | 1.00 | 2.0 |
| APG 325N | 10.0 | 10.0 | 5.0 | 5.0 | 15.0 | 5.0 |
| Dye | 0.01 | 0.01 | 0.01 | 0.01 | 0.01 | |
| Fragrance | 0.1 | 0.1 | 0.1 | 0.1 | 0.1 | |
| Sodium citrate | | | | | | 5.0 |
| Second Solution | | | | | | |
| Calcium chloride | 1.00 | 10.00 | 5.00 | 2.50 | 5.00 | |
| Glycolic acid | 70.0 | 45.0 | 50.0 | 45.0 | | |
| Silver citrate | | | | | 0.01 | |

While various patents have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

We claim:

1. A method of making a cleaning substrate comprising the steps of:

a. providing a substrate layer comprising a melamine foam;

b. forming an active layer on the substrate by i. contacting the substrate layer with a first composition comprising a saccharinic gum; and ii. then contacting the substrate layer with a second composition comprising divalent metal ions and their salts, trivalent metal ions and their salts, and mixtures thereof.

2. The method of claim 1, wherein the first composition additionally comprises an active material selected from the group consisting of a surfactant, a fragrance, a dye, and combinations thereof.

3. The method of claim 1, wherein the first composition additionally comprises an antimicrobial agent.

4. The method of claim 1, wherein the first composition additionally comprises an essential oil.

5. The method of claim 1, wherein the second composition additionally comprises an antimicrobial agent.

6. The method of claim 1, wherein the second composition additionally comprises an essential oil.

7. The method of claim 1, wherein the saccharinic gum is an alginate.

8. A cleaning substrate prepared by the method of claim 1.

9. The cleaning substrate of claim 8, wherein the first composition additionally comprises an active material selected from the group consisting of a surfactant, a fragrance, a dye, and combinations thereof.

10. The cleaning substrate of claim 8, wherein the first composition additionally comprises an antimicrobial agent.

11. The cleaning substrate of claim 8, wherein the first composition additionally comprises an essential oil.

12. The cleaning substrate of claim 8, wherein the second composition additionally comprises an antimicrobial agent.

13. The cleaning substrate of claim 8, wherein the second composition additionally comprises an essential oil.

14. The cleaning substrate of claim 8, wherein the saccharinic gum is an alginate.

* * * * *